US011166553B2

(12) United States Patent
Vogtherr et al.

(10) Patent No.: US 11,166,553 B2
(45) Date of Patent: Nov. 9, 2021

(54) TILTING CHAIR

(71) Applicant: Davis Furniture Industries, Inc., High Point, NC (US)

(72) Inventors: Burkhard Vogtherr, Mulhouse (FR); Jonathan Prestwich, London (GB)

(73) Assignee: Davis Furniture Industries, Inc., High Point, NC (US)

( * ) Notice: Subject to any disclaimer, the term of this patent is extended or adjusted under 35 U.S.C. 154(b) by 0 days.

(21) Appl. No.: 16/891,213

(22) Filed: Jun. 3, 2020

(65) Prior Publication Data

US 2020/0383478 A1 Dec. 10, 2020

Related U.S. Application Data

(60) Provisional application No. 62/857,371, filed on Jun. 5, 2019.

(51) Int. Cl.

| | |
|---|---|
| ***A47C 1/032*** | (2006.01) |
| ***A47C 3/021*** | (2006.01) |
| ***A47C 7/44*** | (2006.01) |
| ***A47C 1/024*** | (2006.01) |

(52) U.S. Cl.

CPC ..... *A47C 1/03255* (2013.01); *A47C 1/024* (2013.01); *A47C 7/44* (2013.01)

(58) Field of Classification Search

CPC ..... A47C 1/024; A47C 1/03255; A47C 7/44
USPC ..... 297/285, 286, 317, 322, 323, 340, 341, 297/342

See application file for complete search history.

(56) References Cited

U.S. PATENT DOCUMENTS 2,615,496 A * 10/1952 Lorenz ..... A47C 1/03272 297/300.5 X
2,830,650 A * 4/1958 Lorenz ..... A47C 1/03255 297/320 X
2,961,035 A * 11/1960 Lorenz ..... A47C 1/035 297/84
3,773,383 A * 11/1973 Ekornes ..... A47C 1/03294 297/342 X (Continued)

FOREIGN PATENT DOCUMENTS

CN 202714512 2/2013
DE 3839453 A1 * 5/1990 ..... A47C 1/03283

(Continued)

OTHER PUBLICATIONS

International Search Report and Written Opinion for PCT Application No. PCT/US2020/035832 dated Aug. 18, 2020.

*Primary Examiner* — Rodney B White
(74) *Attorney, Agent, or Firm* — MacCord Mason PLLC

(57) ABSTRACT

A chair that can transition from an upright position to a reclined position includes a base to rest on a floor, a post upstanding from the base, a chassis affixed to a top of the post and having left and right extensions, armrests extending upward from the left and right extensions. A seat is made up of a seat pan and a seat upper support frame, which are positioned under and above the chassis respectively and has a hole through which the post extends. A backrest has a lower end pivotally joined to the seat and a pivotal connection to each of the armrests, so rearward pressure on an upper area of the backrest causes pivoting of the backrest at the armrests and at the seat, pushing the seat forward to a reclined position in a synchronous motion.

16 Claims, 8 Drawing Sheets

(56) References Cited

U.S. PATENT DOCUMENTS 3,934,932 A * 1/1976 Ekornes ..... A47C 1/0325 297/342 X
4,068,888 A * 1/1978 Bottemiller ..... A47C 1/0325 297/317
4,131,315 A * 12/1978 Vogtherr ..... A47C 1/03 297/286
4,380,352 A * 4/1983 Diffrient ..... A47C 1/036 297/302.1
4,383,714 A * 5/1983 Ishida ..... A47C 3/0257 297/325
4,429,917 A * 2/1984 Diffrient ..... A47C 1/03266 297/322 X
4,504,090 A * 3/1985 Goldman ..... A47C 1/03255 297/317
4,533,177 A * 8/1985 Latone ..... A47C 3/026 297/285 X
4,560,199 A * 12/1985 Sapper ..... A47C 1/03255 297/323 X
4,607,883 A * 8/1986 Tzu-Chun ..... A47C 1/024 297/317
4,641,885 A * 2/1987 Brauning ..... A47C 1/03255 297/303.1
4,703,974 A * 11/1987 Brauning ..... A47C 7/441 297/285
4,768,829 A * 9/1988 Goldman ..... A47C 1/0325 297/317
4,792,187 A * 12/1988 Desanta ..... A47C 1/03255 297/300.5
4,834,453 A * 5/1989 Makiol ..... A47C 1/03261 297/300.4
4,840,426 A 6/1989 Vogtherr et al.
4,865,384 A * 9/1989 Desanta ..... A47C 1/03255 297/300.4
4,877,291 A * 10/1989 Taylor ..... A47C 1/03216 297/322 X
4,889,385 A * 12/1989 Chadwick ..... A47C 3/026 297/286 X
4,971,394 A * 11/1990 Vanderminden ..... A47C 3/023 297/286
4,984,846 A * 1/1991 Ekornes ..... A47C 1/03294 297/317
4,988,145 A * 1/1991 Engel ..... A47C 1/03261 297/286 X
5,015,038 A 5/1991 Mrotz, III
5,048,893 A * 9/1991 Cowan ..... A47C 1/023 297/329
5,102,196 A * 4/1992 Kaneda ..... A47C 7/405 297/285
5,211,444 A * 5/1993 Kjellman ..... A47C 1/0325 297/317 X
5,318,346 A * 6/1994 Roossien ..... A47C 3/12 297/300.1 X
5,338,094 A * 8/1994 Perry ..... A47C 3/04 297/286 X
5,540,481 A * 7/1996 Roossien ..... A47C 3/12 297/300.4
5,577,802 A * 11/1996 Cowan ..... A47C 3/0257 297/301.2
5,630,643 A * 5/1997 Scholten ..... A47C 3/12 297/440.15 X
5,826,940 A * 10/1998 Hodgdon ..... A47C 1/03255 297/303.1
6,070,937 A * 6/2000 Ginat ..... A47C 7/445 297/286 X
6,102,477 A * 8/2000 Kurtz ..... A47C 3/03 297/301.7
6,296,309 B1 * 10/2001 Kurtz ..... A47C 3/12 297/297
6,517,158 B1 * 2/2003 Wang ..... A47C 1/03 297/411.36
6,575,531 B1 * 6/2003 Tseng ..... A47C 1/0325 297/317 X
6,820,936 B2 * 11/2004 Wilkerson ..... A47C 1/03266 297/286 X
7,311,361 B2 * 12/2007 Hung ..... A47C 7/407 297/411.44
7,344,192 B2 3/2008 Kespohl
7,484,803 B2 * 2/2009 Dozsa-Farkas .... A47C 1/03255 297/323 X
7,497,515 B2 * 3/2009 Cowan ..... A47C 3/026 297/300.3
7,896,439 B2 * 3/2011 Kan ..... A47C 7/445 297/286
8,146,990 B2 4/2012 Bock
8,434,822 B2 * 5/2013 Asbjornsen ..... A47C 1/035 297/316
9,198,514 B2 * 12/2015 Machael ..... A47C 1/03272
10,028,586 B2 * 7/2018 Schneider ..... A47C 1/03272
10,231,546 B2 3/2019 Loew et al.
10,321,763 B2 * 6/2019 Bonneywell ..... A47C 7/14
10,966,527 B2 4/2021 Deevers et al.
2003/0015900 A1 * 1/2003 Lu ..... A47C 1/03294 297/259.1
2003/0132652 A1 * 7/2003 Caldwell ..... A47C 11/005 297/258.1
2010/0102606 A1 * 4/2010 Wang ..... A47C 1/03255 297/284.4
2012/0062005 A1 * 3/2012 Cvek ..... A47C 1/03 297/301.1 X
2016/0374471 A1 12/2016 Colonello et al.
2018/0249835 A1 9/2018 Loew et al.
2018/0352961 A1 12/2018 Deevers et al.

FOREIGN PATENT DOCUMENTS

DE 3839455 A1 * 5/1990 ..... A47C 31/02
DE 3839458 A1 * 5/1990 ..... A47C 1/03266
DE 102007059986 6/2009

* cited by examiner

TILTING CHAIR

BACKGROUND OF THE INVENTION

The present invention relates to chairs and the tilt mechanisms for chairs. The preferred use of the chair is in the office chair setting, but the chair can be used in a residence or other setting.

Chairs can come in many shapes and forms, however, the usual chair includes three basic pieces: a seat, a backrest, and a base. Sometimes, chairs are designed to provide the user more comfort. Examples of this include lumbar support and seat cushions. Chairs include adjustable mechanisms, whether for lifting the user or for altering the backrest to a reclined position.

U.S. Pat. No. 4,840,426 ('426 patent) discloses a chair that can alternate between the original and reclined position. When the backrest tilts backwards, the seat is pushed forward, in what has come to be known as "synchronous motion." A spring enclosed in a cylindrical housing is attached to the seat. When the chair is released from the reclined position, the spring pulls the seat backwards into the original position. When the seat moves forward, bearings move through a housing attached to the seat. However, the spring housing is not particularly aesthetically pleasing by the standards of the current market.

There is a need in the art for a synchronous motion chair that is more aesthetically pleasing.

SUMMARY OF THE INVENTION

The invention provides a chair that addresses this need. The chair transitions from an upright position to a reclined position and includes a base to rest on a floor, a post upstanding from the base, a chassis affixed to a top of the post, a seat, and a backrest. The chassis has left and right extensions, with armrests extending upward from the left and right extensions. The backrest has a lower end that pivotally joins the seat and a pivotal connection to each armrest. When rearward pressure is applied to an upper area of the backrest, the backrest moves and pushes the seat forward in a synchronous motion, resulting in the reclined position. When the pressure is released from the upper area of the backrest, the seat returns to its starting, upright position.

The seat is made up of a seat pan and a seat upper support frame that are respectively, under and above the chassis. In some embodiments, the seat upper support frame may have a cushion, such as padding and a fabric or a leather cover. The seat pan can have a hole through which the post extends. The seat pan may also have holes to permit connection between the armrests and left and right extensions. The holes may be elongated to allow the seat to move with little to no hindrance of the post or the armrests and the left and right extensions of the chassis.

The seat pan preferably has a channel that extends fore and aft. The chassis has a lower element that rides in the channel to guide the seat fore and aft during transitions between the upright position and the reclined position. In some embodiments, the chassis can be made of aluminum. The lower element of the chassis can be configured and formed of a material to have low friction with the channel. A tooth extends upward from the lower element of the chassis and a pawl on the seat pan can engage the tooth to prevent transitions between the upright position and the reclined position. There can be more than one tooth that extends along the lower element.

A handle can be used to engage the seat pan to the lower element of the chassis. The handle can be attached to a rod so that when the handle is activated, the rod rotates. The rod, when rotating, causes the pawl to attach or release the tooth. The engagement of the pawl with the tooth prevents the chair from transitioning between the upright position and the reclined position.

The post can include a cylinder with a raising and lowering mechanism and a Bowden cable extending from a cylinder actuator to the cylinder. The Bowden cable can be used as a linkage to an actuator on one side of the seat, so that a person sitting in the seat can operate the cylinder using the actuator.

The seat pan may have at least one downward-facing ramp while the chassis has at least one bearing. The bearing can be a forward bearing. During transitions between the upright position and the reclined position, the bearing travels along the downward facing ramp so a front part of the seat rises relative to a rear part of the seat. The ramp permits transitions between the upright and reclined positions regardless of a person's weight, with relative ease.

Either the seat pan or the chassis may have at least one bumper in order to reduce the impact of the collision when transitioning between the upright and reclined positions. The bumpers may be mounted on the seat pan so that the chassis may collide into the bumpers during transitions. The bumper may be made of a soft plastic or a material designed to reduce noise and damage between the colliding seat pan and chassis.

The seat pan and chassis may be attached to one another by a biasing device. The biasing device returns the chair from the reclined position to the upright position when the force against the upper area of the backrest is removed. The biasing device can be a pair of springs. The springs can attach to the seat pan and the chassis by pins. The pins allow the end of the springs to be hooked, or wrapped, around the pins.

The backrest can be attached to the seat by a hinge. In some embodiments, the backrest connects to the seat pan of the seat by the hinge. The backrest could also be connected to the seat frame. The backrest can attach to the hinge by a lower end of the backrest, so that when the lower end of the backrest moves forward, it extends the hinge forward. This action can cause the seat to move forward, making the chair transition into the reclined position. When the lower end of the backrest moves backward, the seat and the hinge connection to the backrest move backwards to return the chair to the upright position. The backrest is shaped to provide lumbar support. The backrest can have a fabric or leather cover.

The base can comprise of a set of legs extending from the post. Wheels or casters allow the chair to move on the floor. In some embodiments, there are no wheels or casters.

The seat, the backrest, and the pair of armrests can be designed to prevent pinching the user. The hinge between the backrest and the seat can be designed so that the user cannot put a finger within the hinge.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
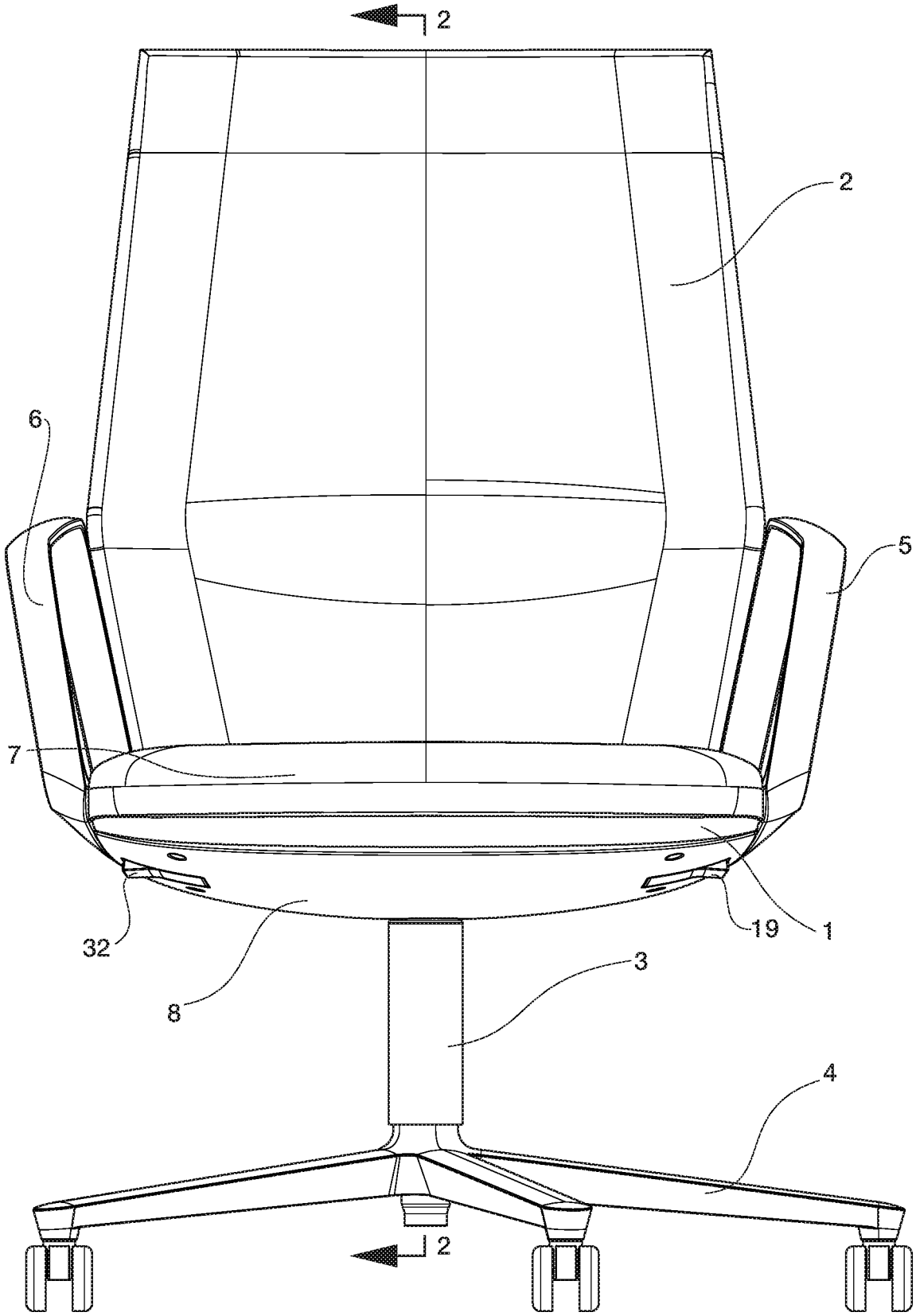
FIG. 1 is a front view of an embodiment of a chair in accordance with the invention.

FIG. 1 shows the front view of a chair in accordance with an embodiment of the invention. The chair includes a base 4, which can be any conventional configuration, but as shown is a 5 legged version, with each of the legs terminating in a caster. The legs come together to support a post 3. Above the post 3 is a seat 1, a back rest 2, and left and right armrests 5 and 6, respectively.

Figure 2:
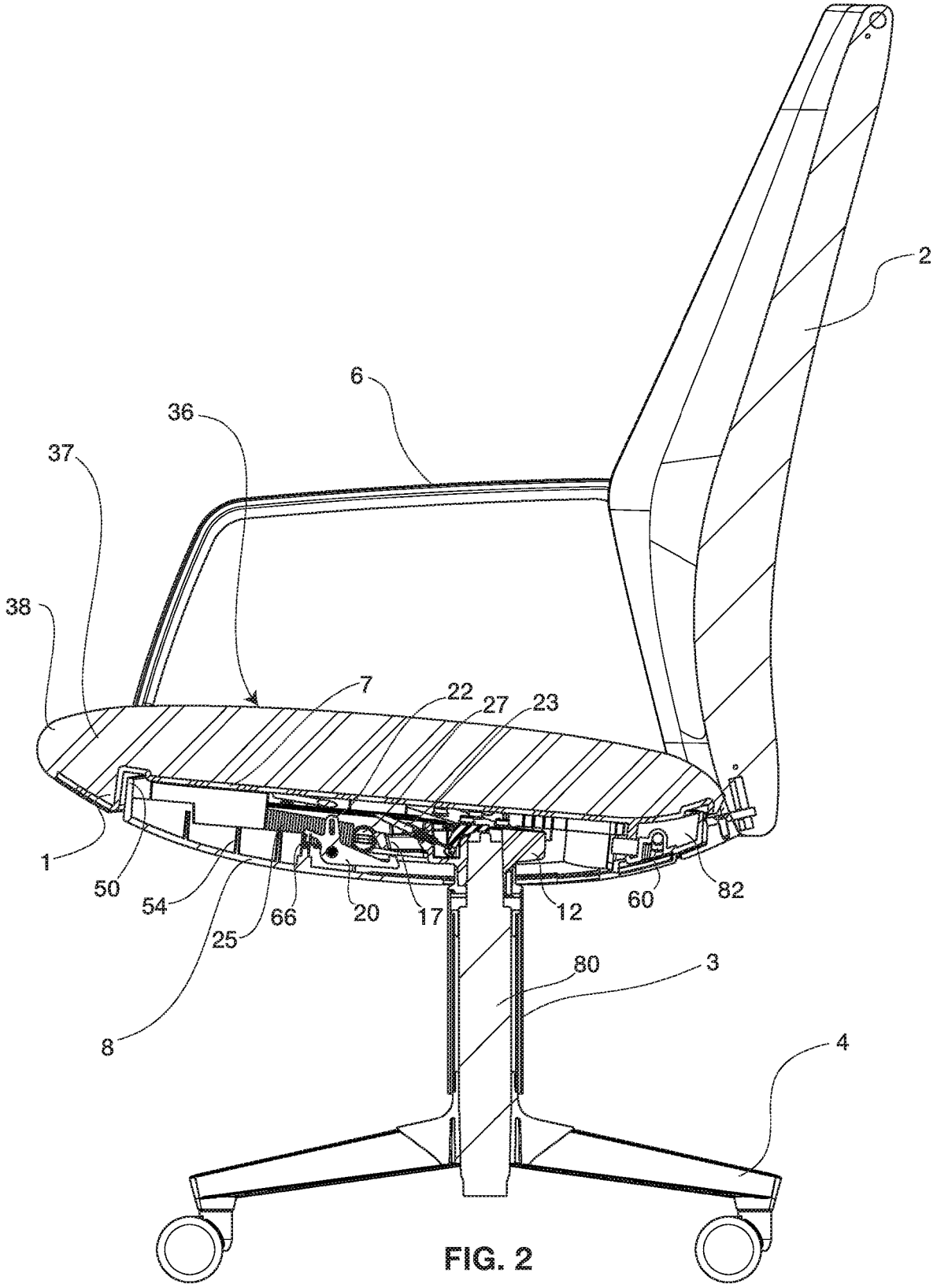
FIG. 2 is a sectional view through the chair of FIG. 1 taken along lines 2-2 and looking in the direction of the arrows.
Figure 4:
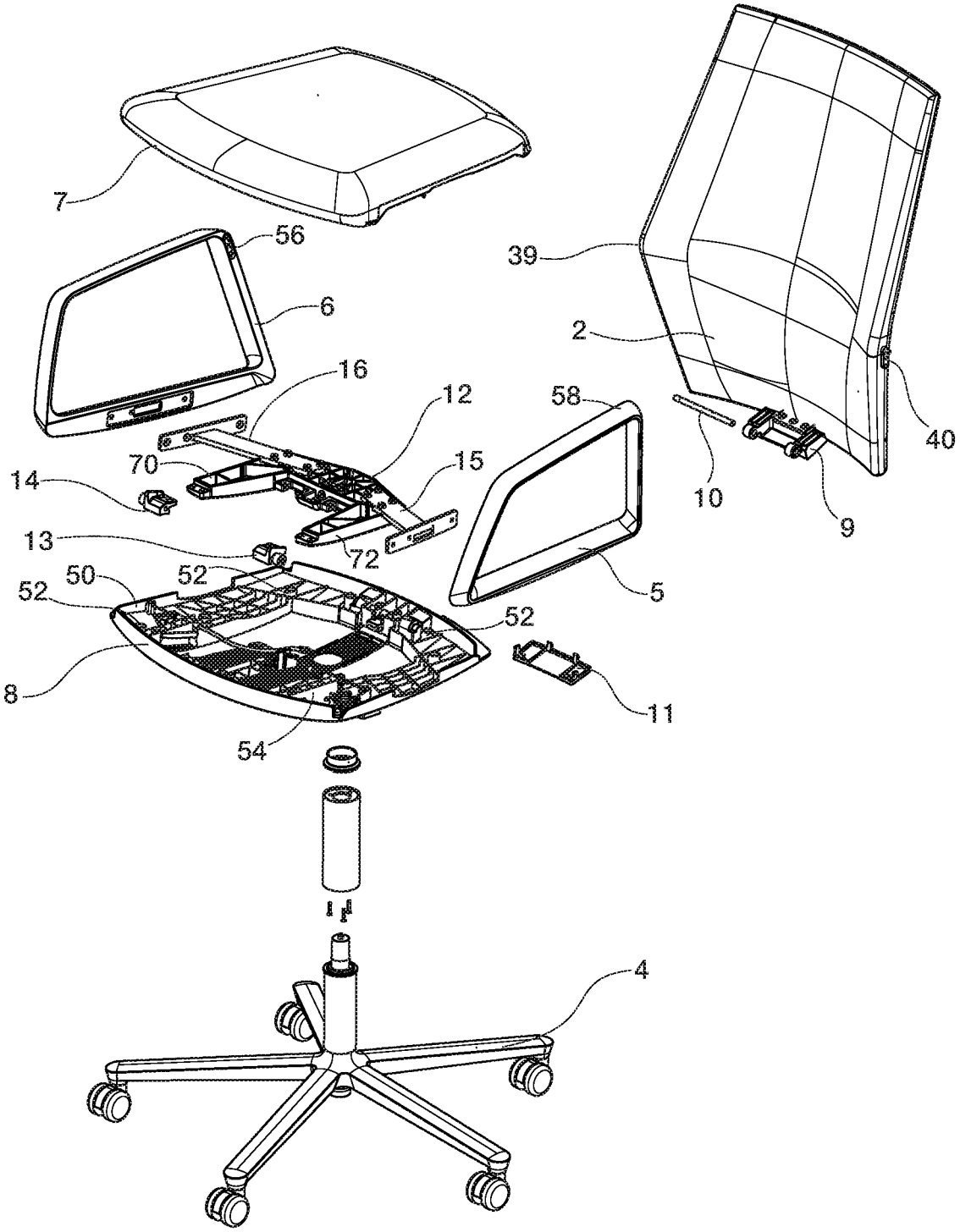
FIG. 4 is an exploded view of the chair.
Figure 5:
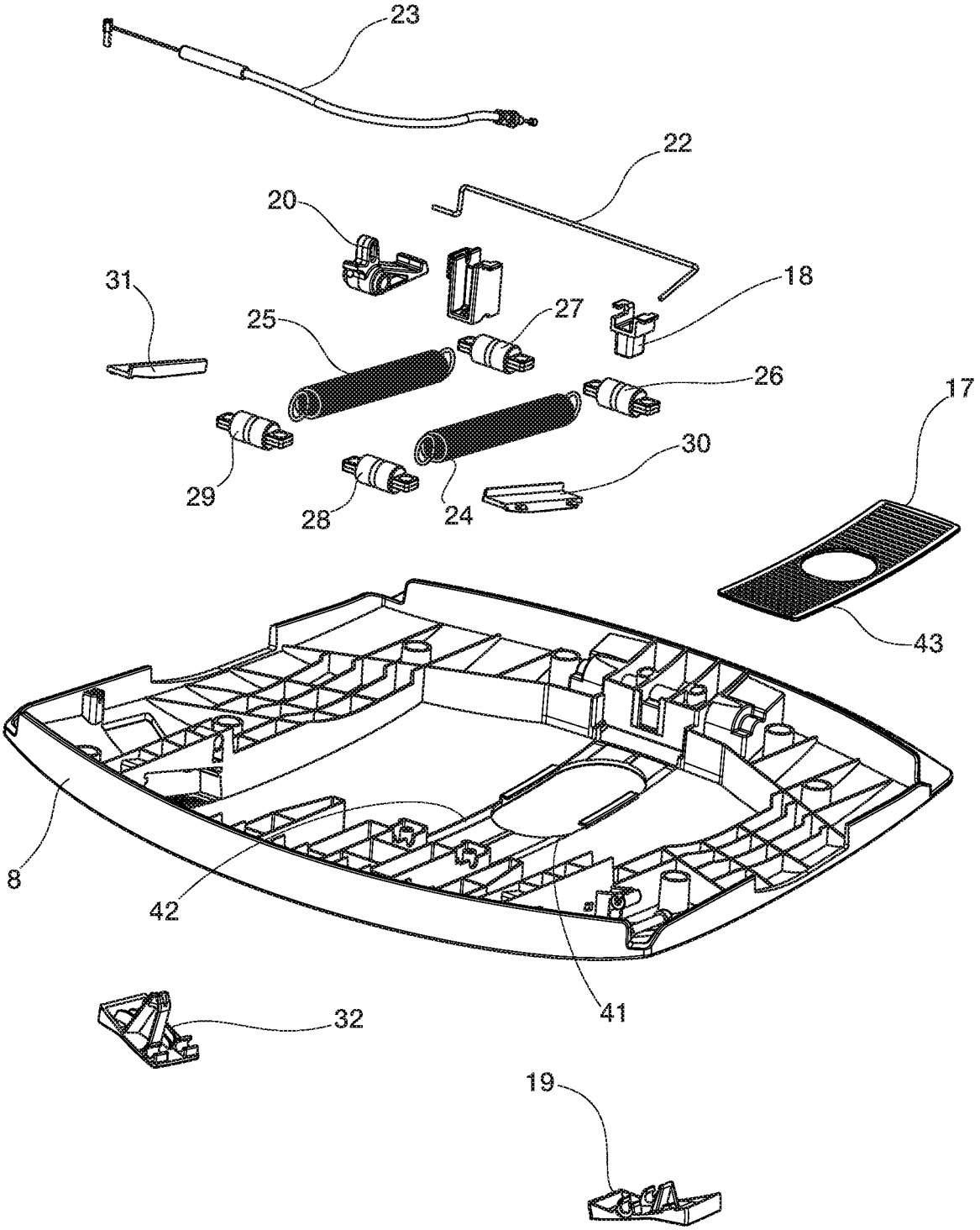
FIG. 5 is an exploded view of the seat pan of the chair and parts that attach to the seat pan.
Figure 6:
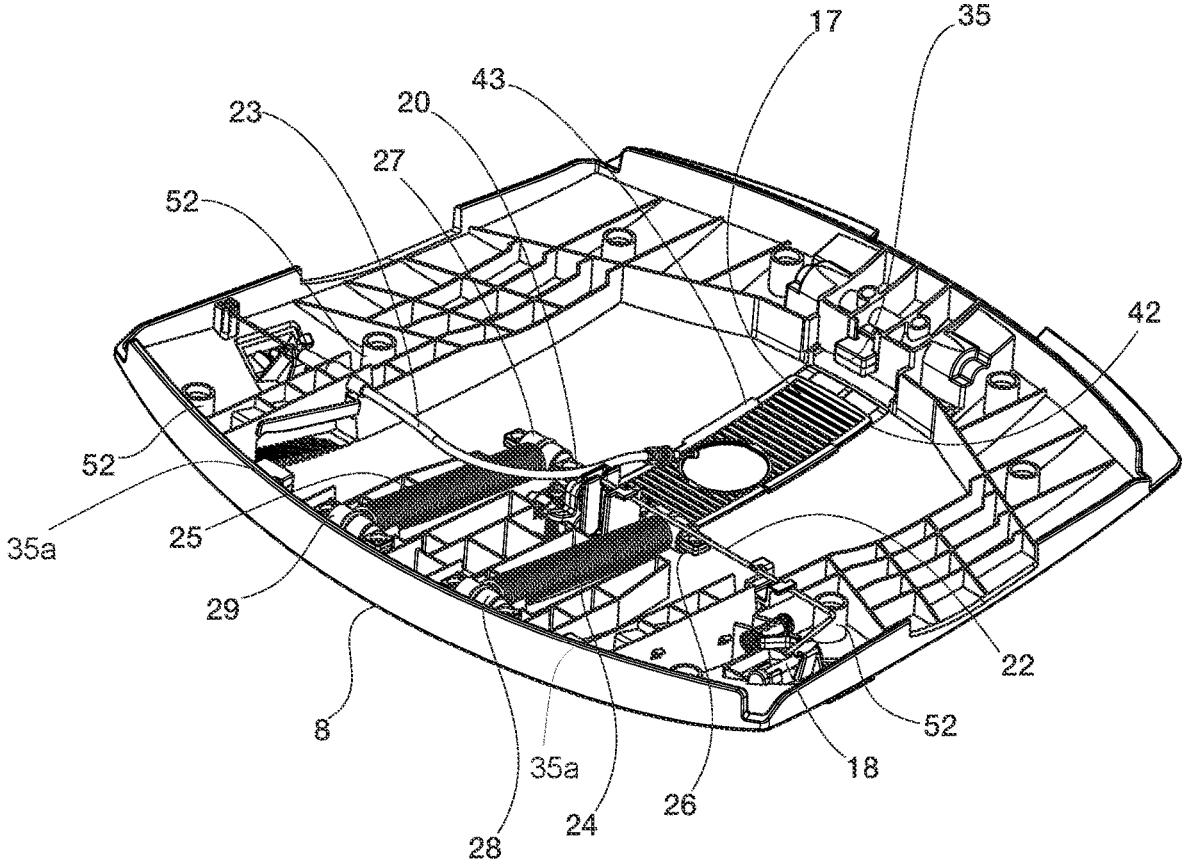
FIG. 6 is a top perspective view of the seat pan of the chair and parts that attach to the seat pan.

As seen in FIGS. 2 and 4, the post 3 supports a chassis 12. The load of the person sitting on the chair is transmitted through various other components to the chassis 12 and then to the post and to the base 4. The chassis 12 is positioned above a seat pan 8 and below a seat upper support frame 7. The seat upper support frame 7 in turn supports a padding 37 and a covering 38 which can be fabric, leather, or other appropriate material. Together the padding and fabric make up the cushion 36.

The weight of the person is transmitted from the cushion to the seat upper support frame, and to the seat pan 8 by contact between mating perimeter edges 50, bosses 52 and bulges 54 where the seat upper support frame 7 contacts the seat pan 8. The seat upper support frame 7 is supported above the seat pan spaced enough above the chassis 12 and extensions 15 and 16 to avoid contact during a transition from an upright to a reclined position.

The seat pan 8 and seat upper support frame 7 are joined by screws that pass upward from the seat pan into the seat upper support frame at the bosses 52. Thus, as assembled, the seat pan 8, seat upper support frame 7, and cushion 36 act as a unit.

As seen in FIG. 4, the chassis 12 has a right extension 16 and a left extension 15 which, in turn, support a right armrest 6 and a left armrest 5. The chassis 12 has two forward extensions 70, 72 that terminate in a right bearing 14 and a left bearing 13. These bearings in the assembled chair are positioned under a right ramp 31 and a left ramp 30 that are affixed to the seat pan 8. The chassis 12 has a lower element 43. The lower element 43 can move in a channel 42 formed in the top of the seat pan. The lower element 43 is preferably sized and shaped and made of a material to have minimal friction in the channel, but to restrict the motion of the seat pan with respect to the chassis 12 to forward and rearward. The seat pan has a hole 41 which is elongated in the fore and aft position. The upper part of the post 3 passes through the hole 41 and also through the hole shown in the lower element 43 and is affixed to the chassis 12. Movement of the seat pan with respect to the post is permitted by the elongated shape of the hole 41.

In preferred embodiments, the post 3 is provided with a conventional gas cylinder 80 to which gas can be admitted or released through a valve operated by a Bowden cable 23 mounted in the seat pan. The Bowden cable connects the cylinder's valve to an actuating switch 32 mounted to the bottom outside of the seat pan. Thus, a person sitting in the seat can actuate the gas cylinder while sitting in the seat by pressing on the switch 32 to permit seat height adjustments.

Figure 7:
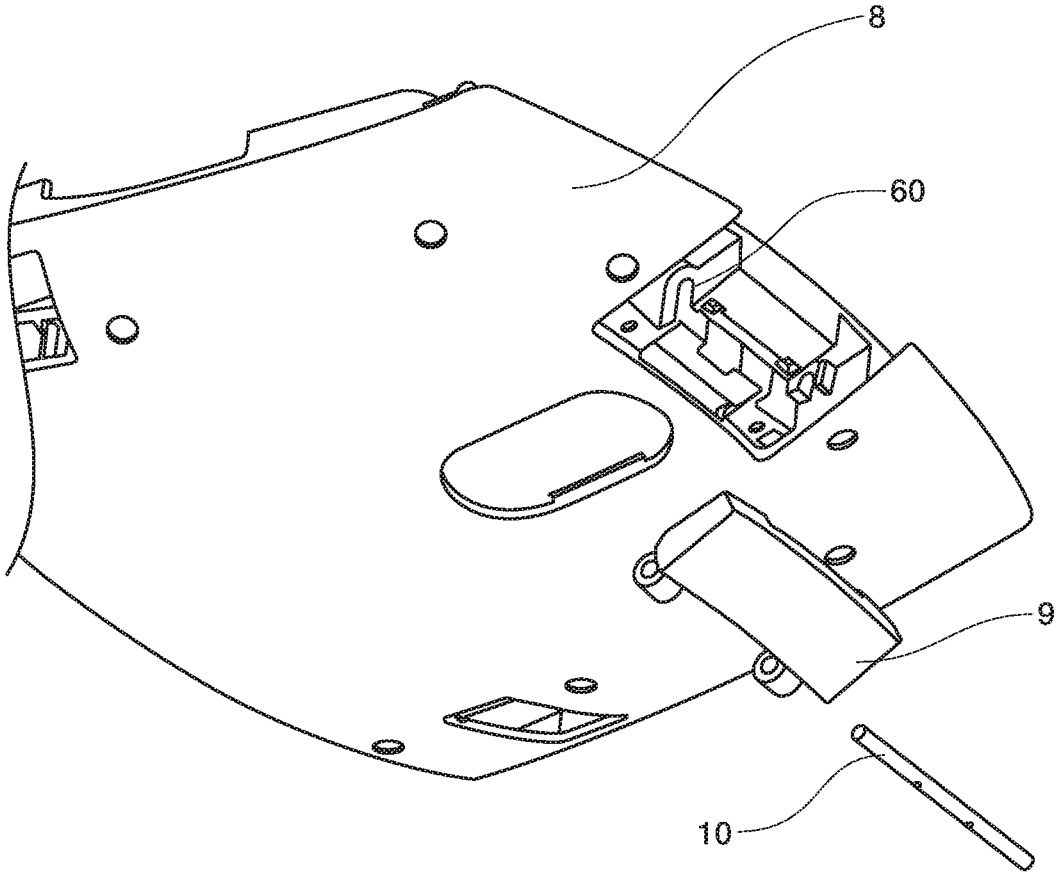
FIG. 7 is a bottom view of the seat pan.
Figure 8:
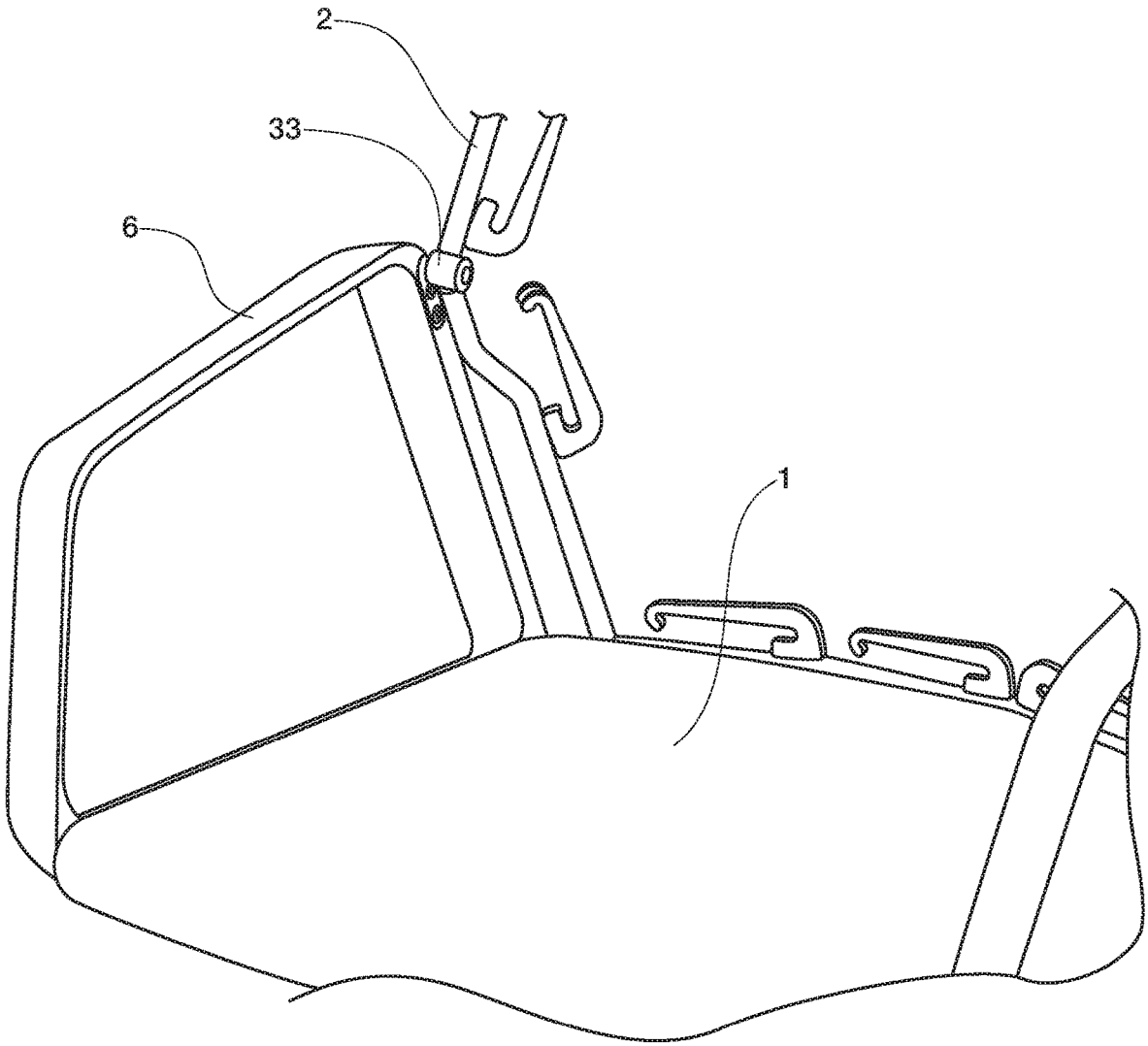
FIG. 8 is a view of the intersection of the seat, armrest and backrest without upholstery.

Horizontal holes 56, 58 at the rear of the armrests 5 and 6 mate with bearings 33 and 34 within the back rest 2. A right armrest pivot pin 39 and a left armrest pivot pin 40 in the holes 56, 58 and bearings 33, 34 allow for a pivoting motion of the back rest about the holes 56, 58 in the armrest. The bottom of the back rest is also provided with a forward extension 82 having a back rest hinge 9 that connects to a pivot bearing 60 at the rear of the seat pan (seen in FIG. 7). The pivot bearing 60 is joined to the bearing 9 of the back rest by a back rest pin 10.

When a person sitting in the seat applies force to an area at the top of the back rest (above the pivot bearings 33 and 34), the back rest acts as a first class lever and pushes forward on the seat pan at the back rest hinge 9. This forward motion of the seat 1 is accommodated by the chassis 12 since there is minimal contact directly between the seat pan, seat upper support frame and the chassis. The contact between the chassis 12 and seat pan 8 is limited to the bearings 13 and 14 that underlie the ramps 30 and 31 of the seat pan and the guiding of the seat pan's channel 42 around the lower element 43. Since the ramps 30 and 31 slope from a higher front elevation to a lower rear elevation, forward motion of the seat pan causes the front of the seat pan to elevate, providing a continuing comfortable position for a person in the seat. The slope of the ramp is selected so that persons of a wide range of sizes and weights such as from 120 to 350 pounds can easily make the transition from an upright position to a reclined position. The transition is a synchronous motion.

Figure 3:
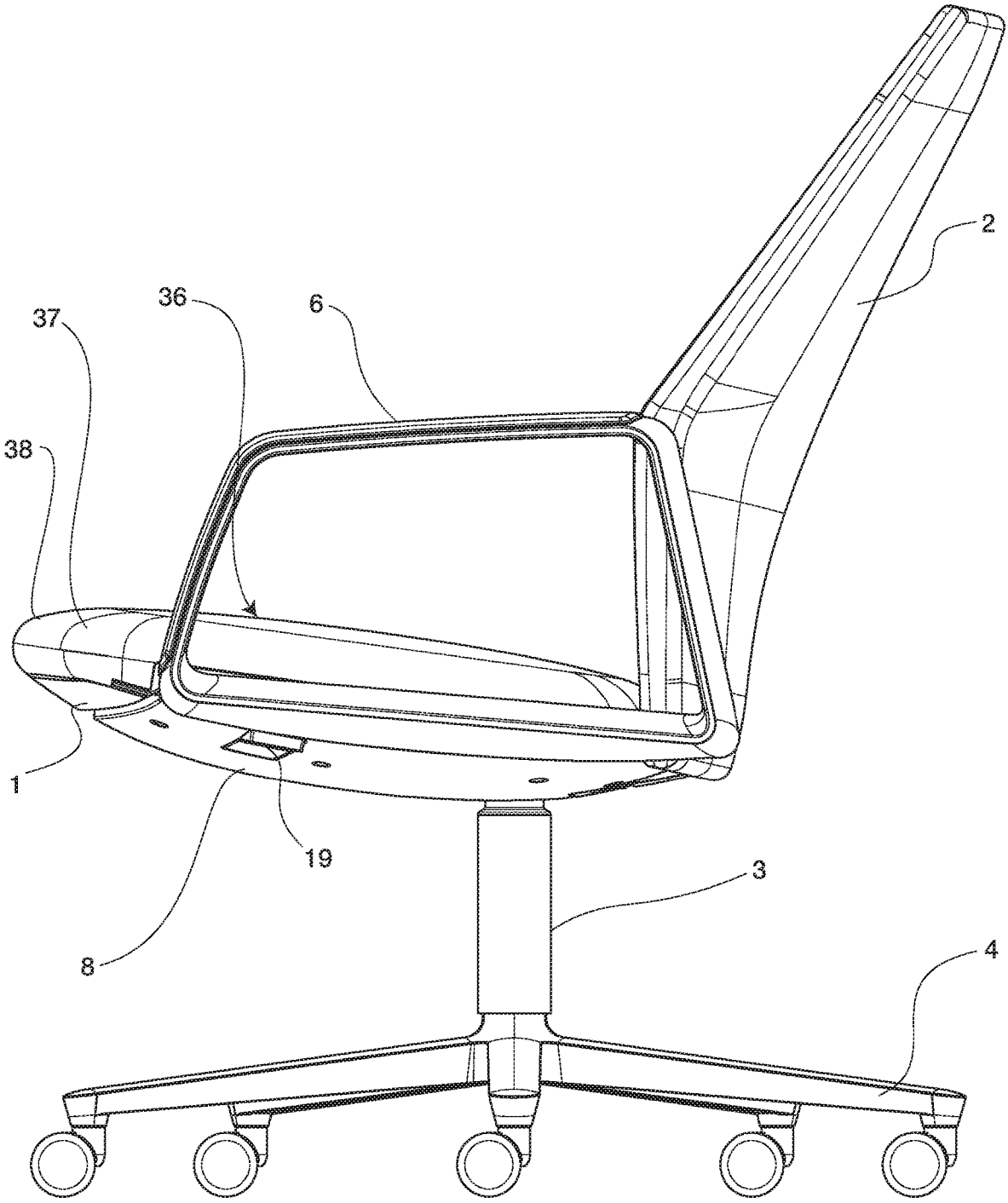
FIG. 3 is a side view of the chair in a reclined position.

The forward motion of the seat 1 is resisted by the springs 24 and 25. The springs 24 and 25 have forward end mountings, respectively, at right seat pin 29 and left seat pin 28 to affix to the seat pan 8 and a rearward end mountings to the chassis 12 at right chassis pin 27 and left chassis pin 26. Thus, the reclining transition extends the springs 24 and 25. When the force on the upper part of the back rest is released, the springs act to restore the seat to the upright position, causing (in the view of FIG. 3) the seat back rest to pivot counterclockwise and the seat 1 to move to the right in a synchronous motion. Bumpers (35 rear and 35*a* forward) reduce the impact of the collision between the seat pan and the chassis when transitioning between the upright and reclined positions.

The preferred embodiments include a locking mechanism so that a user can maintain the chair in the upright position and only transition to the reclined position when such transitions are intended. The locking mechanism includes a tooth 17 on the chassis 12. The tooth 17 is engaged by a pawl 20 that is pivotably mounted to the seat pan 8. An actuating rod 22 extends to the left side of pawl 20 supported in a rod mount 18. The rod mount 18 in turn rests on a handle 19 which is exposed to the left under side of the seat pan 8. The pawl 20 includes a spring 66 to bias it so that the pawl engages the tooth 17. By pressing the handle 19, the rod support 18 is lifted, rotating the elongated portion of the shaft of the rod 22 against the action of the spring 66 on the pawl 20 and lowering the pawl out of engagement with the tooth 17. Releasing the pawl permits the movement of the seat pan with respect to the chassis 12.

Thus when the pawl is released and the user applies pressure to the upper portion of the back rest, the chair can be transitioned from the upright position to the reclined position. When the seat transitions to the upright position under the force of the spring, the pawl re-engages the tooth.

What is claimed is:

1. A chair that can transition from an upright position to a reclined position comprising a base to rest on a floor, a post upstanding from the base, a chassis affixed to a top of the post and having left and right extensions, armrests extending upward from the left and right extensions, a seat made up of a seat pan and a seat upper support frame under and above the chassis respectively, the seat pan having a hole through which the post extends, the hole in the seat pan being long enough in a front-to-rear direction to allow the seat pan to move frontwards or rearwards without being impeded by the post, and a backrest having a lower end pivotally joined to the seat and a pivotal connection to each of the armrests, whereby rearward pressure on an upper area of the backrest causes pivoting of the backrest at the armrests and at the seat, pushing the seat forward to a reclined position in a synchronous motion.

2. A chair as claimed in claim 1 including at least one biasing member extending between the chassis and the seat to restore the chair from the reclined position to the upright position when rearward pressure on an upper area of the backrest ends.

3. A chair that can transition from an upright position to a reclined position comprising a base to rest on a floor, a post upstanding from the base, a chassis affixed to a top of the post and having left and right extensions, armrests extending upward from the left and right extensions, a seat made up of a seat pan and a seat upper support frame under and above the chassis respectively, the seat pan having a hole through which the post extends, and a backrest having a lower end pivotally joined to the seat and a pivotal connection to each of the armrests, whereby rearward pressure on an upper area of the backrest causes pivoting of the backrest at the armrests and at the seat, pushing the seat forward to a reclined position in a synchronous motion, wherein the chassis has an upward extending tooth and the seat pan has a pawl to engage the tooth to prevent transitions from the upright position to the reclined position until the pawl is released.

4. A chair as claimed in claim 3 wherein the pawl has a linkage to an actuator on one side of the seat, so a person sitting in the seat can release the pawl using the actuator.

5. A chair that can transition from an upright position to a reclined position comprising a base to rest on a floor, a post upstanding from the base, a chassis affixed to a top of the post and having left and right extensions, armrests extending upward from the left and right extensions, a seat made up of a seat pan and a seat upper support frame under and above the chassis respectively, the seat pan having a hole through which the post extends, and a backrest having a lower end pivotally joined to the seat and a pivotal connection to each of the armrests, whereby rearward pressure on an upper area of the backrest causes pivoting of the backrest at the armrests and at the seat, pushing the seat forward to a reclined position in a synchronous motion, and wherein the post has a cylinder raising and lowering mechanism, and the seat has a Bowden cable extending from a cylinder actuator to the cylinder.

6. A chair that can transition from an upright position to a reclined position comprising a base to rest on a floor, a post upstanding from the base, a chassis affixed to a top of the post and having left and right extensions, armrests extending upward from the left and right extensions, a seat made up of a seat pan and a seat upper support frame under and above the chassis respectively, the seat pan having a hole through which the post extends, and a backrest having a lower end pivotally joined to the seat and a pivotal connection to each of the armrests, whereby rearward pressure on an upper area of the backrest causes pivoting of the backrest at the armrests and at the seat, pushing the seat forward to a reclined position in a synchronous motion, wherein the seat pan has a channel that extends fore and aft, and the chassis has a lower element that rides in the channel to guide the seat to fore and aft during transitions between the upright position and the reclined position.

7. A chair as claimed in claim 6 wherein the lower element of the chassis is configured and formed of a material to have low friction with the channel.

8. A chair that can transition from an upright position to a reclined position comprising a base to rest on a floor, a post upstanding from the base, a chassis affixed to a top of the post and having left and right extensions, armrests extending upward from the left and right extensions, a seat made up of a seat pan and a seat upper support frame under and above the chassis respectively, the seat pan having a hole through which the post extends, and a backrest having a lower end pivotally joined to the seat and a pivotal connection to each of the armrests, whereby rearward pressure on an upper area of the backrest causes pivoting of the backrest at the armrests and at the seat, pushing the seat forward to a reclined position in a synchronous motion, wherein the seat pan has at least one downward-facing ramp, and the chassis has at least one forward bearing under the downward facing ramp so a front part of the seat rises relative to a rear part of the seat during transitions between the upright position and the reclined position.

9. A chair as claimed in claim 8 wherein the ramp is shaped to permit transitions between the upright position and the reclined position regardless of a person's weight.

10. A chair that can transition from an upright position to a reclined position comprising a base to rest on a floor, a post upstanding from the base, a chassis affixed to a top of the post and having left and right extensions, armrests extending upward from the left and right extensions, a seat made up of a seat pan and a seat upper support frame under and above the chassis respectively, the seat pan having a hole through which the post extends, and a backrest having a lower end pivotally joined to the seat and a pivotal connection to each of the armrests, whereby rearward pressure on an upper area of the backrest causes pivoting of the backrest at the armrests and at the seat, pushing the seat forward to a reclined position in a synchronous motion, and wherein the lower end of the backrest has a forward extension, and the backrest is pivotally joined to the seat at the forward extension.

11. A chair as claimed in claim 1 wherein the seat upper support chassis has upper padding and a fabric or leather cover.

12. A chair that can transition from an upright position to a reclined position comprising a base to rest on a floor, a post upstanding from the base, a chassis affixed to a top of the post and having left and right extensions, armrests extending upward from the left and right extensions, a seat made up of a seat pan and a seat upper support frame under and above the chassis respectively, the seat pan having a hole through which the post extends, and a backrest having a lower end pivotally joined to the seat and a pivotal connection to each of the armrests, whereby rearward pressure on an upper area of the backrest causes pivoting of the backrest at the armrests and at the seat, pushing the seat forward to a reclined position in a synchronous motion, wherein forward and rear bumpers soften the impact of the chassis with the seat pan when transitions between the upright position and the reclined position finish.

13. A chair as claimed in claim 12 wherein the bumpers are mounted to the seat pan.

14. A chair that can transition from an upright position to a reclined position comprising a base to rest on a floor, a post upstanding from the base, a chassis affixed to a top of the post and having left and right extensions, armrests extending upward from the left and right extensions, a seat made up of a seat pan and a seat upper support chassis under and above the chassis respectively, the seat pan having a hole through which the post extends, the hole being long enough in a front-to-rear direction to allow the seat pan to move without being impeded by the post, a backrest having a lower end with a forward extension that pivotally joins the backrest to the seat, the backrest having a pivotal connection to each of the armrests, whereby rearward pressure on an upper area of the backrest causes pivoting of the backrest at the armrests and at the seat, pushing the seat forward to a reclined position in a synchronous motion, the seat pan having a channel that extends fore and aft and the chassis having a lower element formed of a material to have low friction with the channel that rides in the channel to guide the seat to fore and aft during transitions between the upright position and the reclined position, wherein forward and rear bumpers mounted to the seat pan soften the impact of the chassis with the pan when transitions between the upright position and the reclined position finish, at least one biasing member extending between the chassis and the seat to restore the chair from the reclined position to the upright position when rearward pressure on an upper area of the backrest ends, wherein the seat pan has an upward extending tooth, and the chassis has an operable latch to engage the tooth to prevent transitions from the upright position to the reclined position until the latch is operated, and wherein the seat pan has at least one downward-facing ramp, and the chassis has at least one forward bearing under the downward facing ramp so a front part of the seat rises relative to a rear part of the seat during transitions between the upright position and the reclined position.

15. A tilt mechanism comprising:

a chassis, a pair of springs, and a pair of bearings;

wherein the tilt mechanism can be placed within a chair;

wherein the chassis is U-shaped and has left and right extensions and a forward opening so that and lock the chassis in place within the chair;

wherein the pair of springs have one end that attaches to the chassis, so that as the chassis moves, the pair of springs expand and contract and the opposite end of the pair of springs is attached to the chair;

wherein the bearings are attached to forward ends of the left and right extensions of the chassis and ride within the chair; and wherein a lower element of the chassis is configured and formed of a material to have low friction with the chair.

16. A tilt mechanism as claimed in claim 15, wherein the chassis is made of aluminum.

* * * * *